US011624516B2

(12) United States Patent
Saigol et al.

(10) Patent No.: US 11,624,516 B2
(45) Date of Patent: Apr. 11, 2023

(54) AIR CONDITIONER SYSTEMS AND METHODS

(71) Applicant: DON'T BE HOT CORP., New York, NY (US)

(72) Inventors: Muhammad Abdullah Haroon Saigol, New York, NY (US); Erik Palmer Rauterkus, Pittsburgh, PA (US); Joseph Lyle Koch, Ventura, CA (US)

(73) Assignee: DON'T BE HOT CORP., New York, NY (US)

( * ) Notice: Subject to any disclaimer, the term of this patent is extended or adjusted under 35 U.S.C. 154(b) by 322 days.

(21) Appl. No.: 16/931,702

(22) Filed: Jul. 17, 2020

(65) Prior Publication Data

US 2021/0148583 A1 May 20, 2021

Related U.S. Application Data

(60) Provisional application No. 62/935,331, filed on Nov. 14, 2019, provisional application No. 62/935,327, filed on Nov. 14, 2019.

(51) Int. Cl.
*F24F 1/031* (2019.01)
*F24F 13/20* (2006.01)

(52) U.S. Cl.
CPC ..... *F24F 1/031* (2019.02); *F24F 13/20* (2013.01)

(58) Field of Classification Search
CPC .. F24F 1/0043; F24F 1/027; F24F 1/03; F24F 1/031; F24F 13/20; F24F 13/32; F24F 2210/20
See application file for complete search history.

(56) References Cited

U.S. PATENT DOCUMENTS 3,030,873 A * 4/1962 Metcalfe ..... F24F 1/04 454/203
2011/0241621 A1* 10/2011 Inoue ..... H02J 7/0045 320/113

FOREIGN PATENT DOCUMENTS

CN 201628349 U * 11/2010
JP H01193534 A * 8/1989

* cited by examiner

*Primary Examiner* — Edelmira Bosques
*Assistant Examiner* — Michael James Giordano
(74) *Attorney, Agent, or Firm* — Buckley, Maschoff & Talwalkar LLC

(57) ABSTRACT

Air conditioner systems and methods are provided. In some embodiments, an air conditioner is installed using an installation frame. In some embodiments, an air conditioner system includes a latch mechanism positioned proximate a bottom surface of an air conditioner unit, the latch mechanism having a latch release mechanism and a latch engagement mechanism to engage with a latch recess of a frame body.

14 Claims, 11 Drawing Sheets

AIR CONDITIONER SYSTEMS AND METHODS

CROSS REFERENCE TO RELATED APPLICATIONS

This application claims benefit of and priority to U.S. Provisional Patent Application Ser. Nos. 62/935,327 and 62/935,331 both of which were filed on Nov. 14, 2019, the contents of each of which are hereby incorporated by reference in their entirety for all purposes.

FIELD

This application relates to air conditioner systems and methods for installation.

BACKGROUND

Air conditioning units mounted in openings such as window openings are in common use. These units are typically inserted into a window opening and are held in place by a lip mounted on or formed on a top of the air conditioning unit. The lip sits against an interior surface of a top of the window opening (e.g., such as against a window sash that is closed against the top of the air conditioning unit). The positioning of the lip against the top of the window opening is intended to prevent the air conditioning unit from falling backwards outside of the window opening. Unfortunately, this approach is prone to failure. Users frequently add platforms or other security mechanisms to the exterior of the building to prevent units from falling.

These air conditioning units can be heavy and unwieldy and are particularly hard to install in windows that do not permit an installer to hold or manipulate the unit from the outside (e.g., in buildings of greater than a single story in height). Further, these units are often not aesthetically pleasing. The interior front surface of these units commonly are plastic and are dominated by vents that intake and exhaust air into the room.

It would be desirable to provide systems and methods for air conditioners that overcome these deficiencies.

DETAILED DESCRIPTION

Applicants have realized that it would be desirable to provide systems and methods for more easily and securely installing air conditioner units in openings such as window openings. Embodiments provide air conditioner systems having installation frames that are first mounted within a window opening and that are configured to allow an air conditioner unit to be easily slid into the installation frame and securely latched to the frame. Once installed and latched, the air conditioner unit is securely retained within the frame and in the window opening without need for additional platforms or security. Embodiments facilitate easy and secure installation and removal of air conditioner units.

For convenience and ease of exposition, a number of terms are used herein. For example, the term "air conditioner system" is used to refer to an air conditioner unit as well as components for mounting the air conditioner unit in a window or other opening. For example, an air conditioner system may include an air conditioner unit, an installation frame, front trim, and other components as will be described further herein.

For convenience and ease of exposition, air conditioner systems pursuant to embodiments of the present invention will be described as being mounted in "windows" or "window openings", however, those skilled in the art, upon reading the present disclosure, will appreciate that air conditioner systems pursuant to the present invention may be installed in other openings (e.g., such as specially constructed openings sized to fit the air conditioner system or the like).

Figure 1:
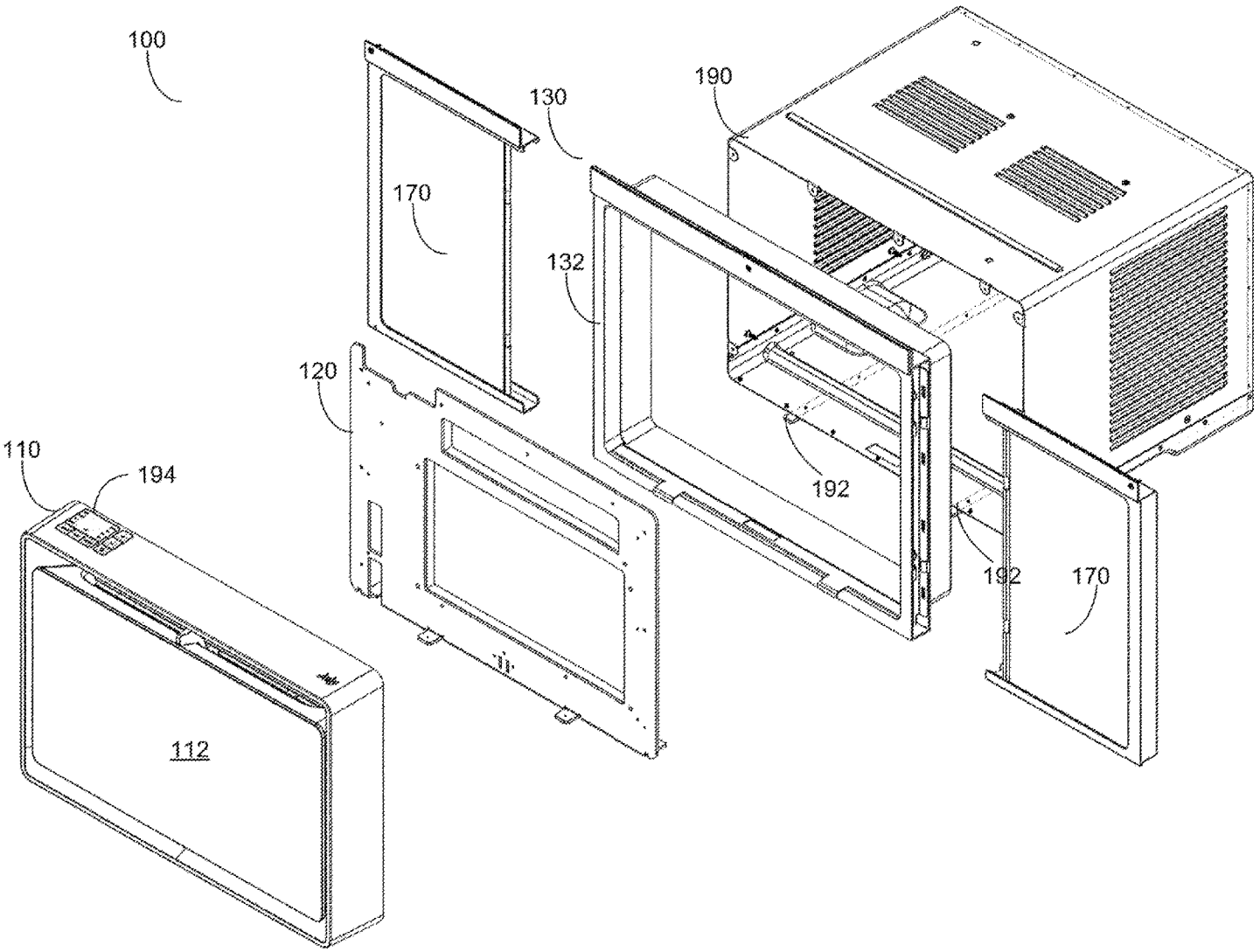
FIG. 1 is front facing exploded view of an air conditioner system pursuant to some embodiments.

Features of some embodiments of the present invention will now be described by first referring to FIG. 1 which is a front facing exploded view of an air conditioner system 100 pursuant to some embodiments. As shown, an air conditioner system 100 includes a number of components, including an air conditioner unit housing 190 which houses electronics and other components (not shown) to cause air to be cooled and returned to cool the interior while exhausting heat to the exterior of a building. For convenience and ease of exposition, the air conditioner unit housing 190 may also be referred to herein as an air conditioner unit 190. The air conditioner system 100 also includes an installation frame 130. The installation frame 130 consists of a frame body 132 and curtain assemblies 170 positioned on either side of the frame body 132. The installation frame 130 fits within a window opening (as will be described further below in conjunction with FIG. 8).

Pursuant to embodiments of the present invention, an air conditioner system 100 is installed by first positioning the installation frame 130 in a window opening. The frame body 132 has a bottom rail and tabs that are positioned along an inner ledge of the window—with the tabs on the inside of the ledge and the bottom rail on the outside of the ledge. A top rail of the frame body 132 may be secured to the upper window sash (e.g., using a screw or other mechanism). Then, after the installation frame 130 is installed, the air conditioner unit 190 is simply slid into the recess of the frame body 132 until a latching mechanism (not shown in FIG. 1 but described in detail below) engages with the bottom rail of the frame body 132. The installation frame 130 causes the air conditioner unit 190 to easily be installed in a window opening without fear of the unit falling through the window. The air conditioner unit 190 can be uninstalled just as easily. A latching mechanism on the unit is disengaged and the air conditioner unit 190 is slid out of the installation frame 130. The installation frame is then removed from the window opening. Further details of the installation will be provided further below.

The frame body 132 forms a recess into which the air conditioner unit 190 is inserted such that the air conditioner unit 190 securely fits in the frame body 132. A latching mechanism (not shown in FIG. 1) securely latches the air conditioner unit 190 within the frame body 132. While the mechanism is referred to herein as a "latching" mechanism or a "latch", that term is used only for convenience. In general, the latching mechanism may include a latch release mechanism (e.g., such as a button or other mechanism that a user can interact with to release the latch mechanism) and a latch engagement mechanism (e.g., such as a latch catch, a pin or other insert that mates with a receiver or the like to engage the latch). Various embodiments of latching mechanisms will be described further below. Embodiments may utilize other methods to secure the air conditioner unit 190 within the frame body 132. For example, the latching mechanism may consist of a system of pins or deadbolts or cams or the like, so long as the air conditioner unit 190 may be secured to the frame body 132 and so long as a user may easily deactivate or unlock the latching mechanism to remove the air conditioner unit 190 from the frame body 132.

The frame body 132 is sized such that it has a depth (in a direction extending from the front of the unit to the rear of the unit when the air conditioner unit 190 is inserted into the frame body 132) that is selected to provide a secure base for the air conditioner unit 190. More particularly, in some embodiments, the depth is selected such that there is sufficient depth to control the orientation of the air conditioner unit 190 when it is slid into the frame body 132. For example, due to the weight of a typical air conditioner unit, when the unit is slid into the frame body 132, it may tend to angle downward (toward the outside of the window, with the tendency to angle downward increasing as the center of mass of the unit extends past the frame). If this orientation is not corrected, the air conditioner unit 190 may not be properly installed in the frame body 132. The depth of the bottom rail of the frame body 132 may be selected to reduce this misorientation and to keep the air conditioner unit 190 substantially perpendicular to the bottom rail until the air conditioner unit 190 can be secured with the latch mechanism. The dimensions of the bottom rail may be selected based on the size of the air conditioner unit 190 (including the depth, measured from the face of the unit to the rear of the unit) as well as the size of the window frame. In general, the depth of the bottom rail of the frame body 132 is selected to provide some support and to properly guide the air conditioner unit 190 as it is slid into the frame body 132.

In some embodiments, the air conditioner unit 190 has one or more slide rails 192 which are formed of a hard plastic material and shaped to allow the air conditioner unit 190 to be easily slid into the frame body 132. The slide rails 192 reduce the friction and ensure proper unit alignment when the air conditioner unit 190 is slid into the frame body 132.

The installation frame 130 is configured to allow the air conditioner unit 190 to be securely mounted in a window opening. The curtain assemblies 170 are configured to close the window opening that may exist on either side of the frame body 132 and air conditioner unit 190. Further details of the structure of the installation frame 130, frame body 132 and curtain assemblies 170 will be provided below.

The air conditioner unit 190 also includes a front plate 120 which is securely connected to a front portion of the air conditioner unit 190 as will be described further below. The front plate 120 includes a number of recesses or cutouts that are positioned and sized to provide access to air ducts, electronics, and other elements of the air conditioner unit 190. The front plate 120 also provides attachment points for a latch mechanism that will be described further herein. A front trim assembly 110 mounts on the front face of the air conditioner unit 190 and is attached to the front plate 120. The front trim assembly 110 includes, in some embodiments, a control panel 194 providing controls to operate the air conditioner unit 190. A decorative front panel 112 is mounted on an interior facing surface of the air conditioner system 100 and will be described further below in conjunction with FIG. 7.

Figure 2:
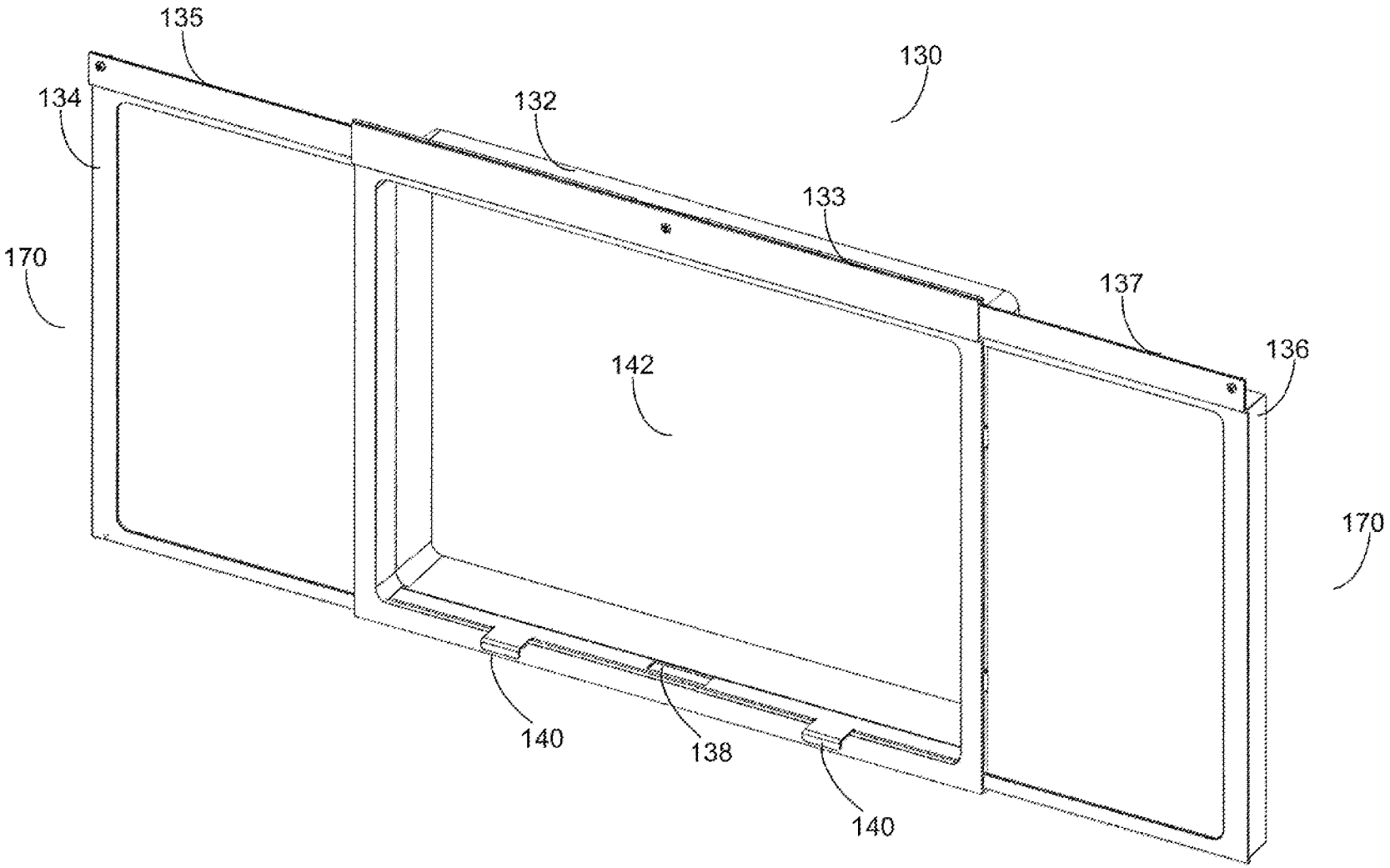
FIG. 2 is a view of an installation frame pursuant to some embodiments.

Further details of the installation frame 130, frame body 132 and curtain assemblies 170 will now be provided by referring to FIG. 2 which is a perspective view of the curtain assemblies 170 mounted on the frame body 132. Each curtain assembly 170 has a frame 134, 136 which is configured to slidably mate with the frame body 132. A top rail lip 135, 137 of the curtain frames 134, 136 is shaped to slide within a top rail lip 133 of the frame body 132. For example, the top rail lip 133 of the frame body 132 may be shaped with a recess sized to receive the top rail lip 135, 137 of the curtain assemblies 170. The curtain assemblies 170 may thus be extended or retracted to effectively make the width of the frame body 132 larger or smaller to fit different size window openings. The frame body 132 is configured to form a recess 142 sized and shaped to receive an air conditioner unit 190 as described herein.

Pursuant to some embodiments, the frame body 132 has a latch recess 138 formed in a bottom of the frame body 132 as well as one or more bottom rail tabs 140. In general, in some embodiments, the bottom rail tabs 140 serve several purposes. For example, in some embodiments, the bottom rail tabs 140 are designed to catch the frame body 132 on an inner ledge of the window frame in which the frame body 132 is installed. Many window frames have an inner ledge that serves to prevent water from outside the building from seeping in from the bottom of the window. The bottom rail tabs 140 serve to hold the frame body 132 in position within the window frame while an air conditioner unit 190 is inserted into the frame body 132. The bottom rail tabs 140 also serve to hold the frame body 132 in position after the unit is installed. In some embodiments, the bottom rail tabs 140 also serve to secure a front face of the frame body 132 as will be described further below. Further details of the latch recess 138 and bottom rail tabs 140 will be described further below in conjunction with FIGS. 3 and 6.

Figure 3:
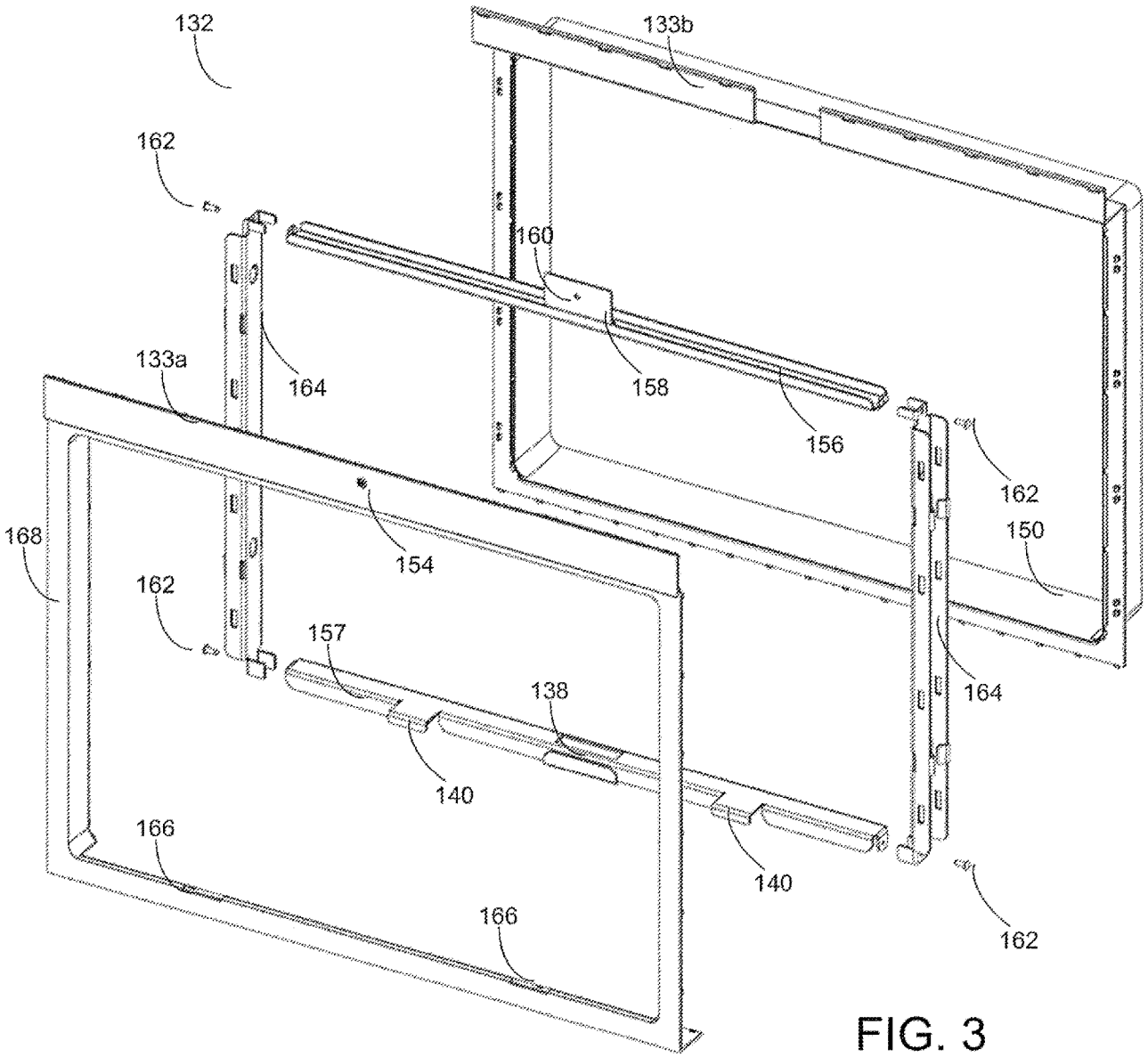
FIG. 3 is an exploded view of portions of an installation frame pursuant to some embodiments.

Reference is now made to FIG. 3 where an exploded view of one embodiment of the components of the frame body 132 is shown. In the embodiment depicted, the frame body 132 is formed by assembling three components together—a frame housing 150, a set of rails (including side rails 164, top rail 156 and bottom rail 157) and a frame face 168. The frame body 132 is generally assembled by positioning the set of rails on the frame housing 150 and enclosing the rails between the frame housing 150 and the frame face 168. The bottom rail tabs 140 are inserted into the apertures 166 of the frame face 168 and the top rail lip 133*a* attaches to the top rail lip 133*b* of the frame housing 150 to form a recess to receive the corresponding top rail lips 135, 137 from the curtain assemblies 170 (not shown in FIG. 3).

In some embodiments, the frame face 168 is a cosmetic cover formed of injection molded plastic. The frame housing 150, in some embodiments, may be formed of injection molded plastic and may have a depth (as measured from the front of the frame body 132 to the rear of the frame body 132) selected to provide a stable platform and to properly guide the air conditioner unit 190 as it is slid through the frame body 132 as described elsewhere herein. The set of rails (including side rails 164, top rail 156 and bottom rail 157) may be formed of stamped sheet metal and provide rigidity to the frame body 132. The bottom rail 157 has sufficient height that it catches on an inner ledge of the window frame. As discussed above, the bottom rail tabs 140 catch on one edge of the inner ledge of the window frame (to prevent the frame body 132 from being pushed out of the window as an air conditioner unit 190 is installed. The bottom rail 157 acts to press against an outer edge of the inner ledge of the window frame as the weight of the air conditioner unit 190 tends to cantilever the unit and frame against the inner ledge.

Figure 4:
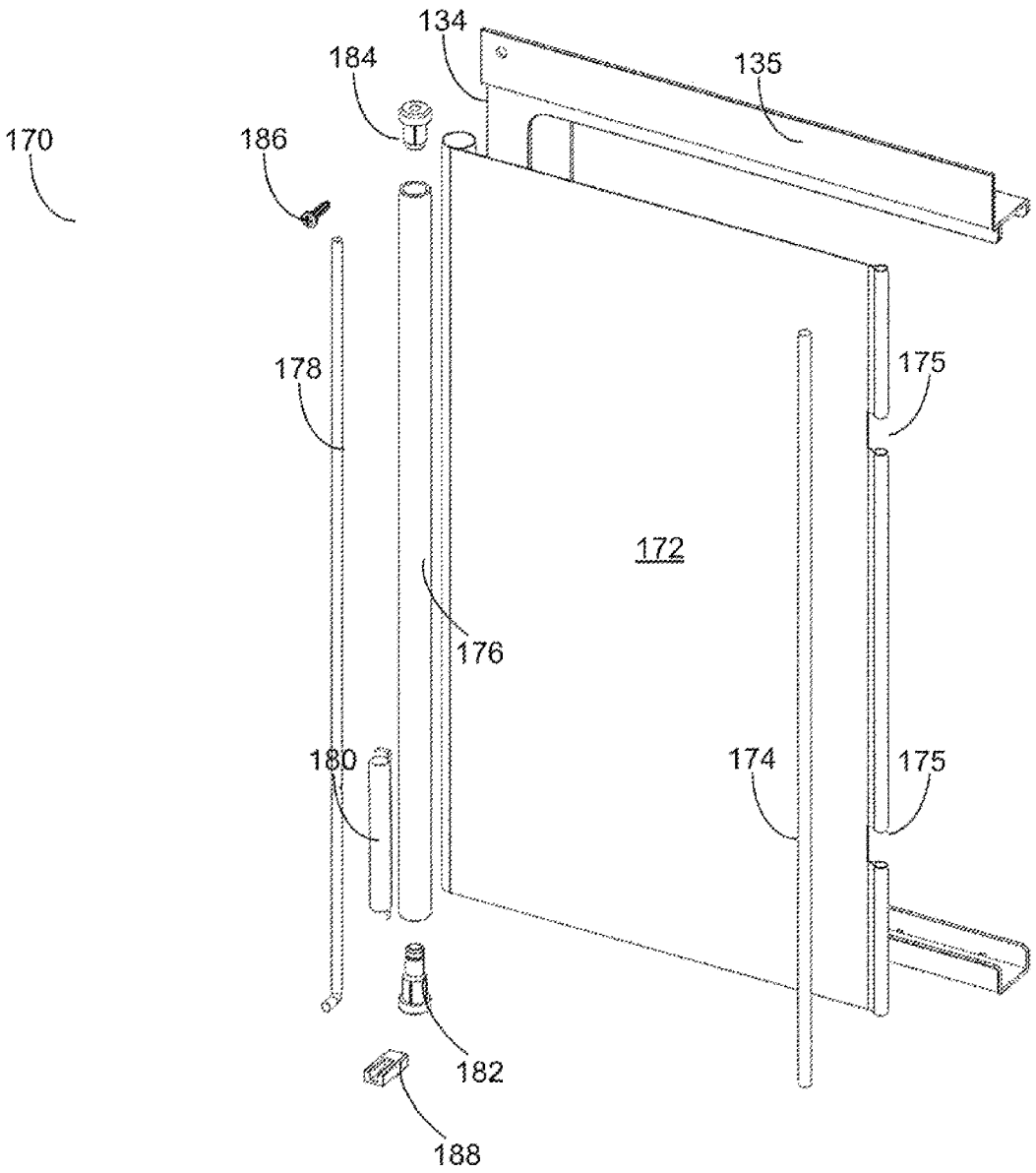
FIG. 4 is an exploded view of portions of a curtain assembly pursuant to some embodiments.

Reference is now made to FIG. 4 where further details of a curtain assembly 170 is shown. Pursuant to some embodiments, the curtain assembly 170 is constructed to allow the assembly to expand or contract to fit different size window openings. Ideally, the curtain assembly 170 is able to substantially completely close the window opening that may exist on either side of the air conditioner unit to prevent cool air from escaping the interior of the building and to prevent unwanted pests or weather from entering. Embodiments provide a visually appealing and easy to install curtain assembly that overcomes prior art problems where rubber or plastic assemblies failed to properly cover the opening, were hard to install (sometimes requiring installation with screws) and were visually unappealing.

Each curtain assembly 170 includes a number of components, including a frame 134, a top rail lip 135, a curtain fabric 172 and components to allow the extension and retraction of the curtain fabric 172 as the curtain assembly 170 extends or retracts from the body of the air conditioner unit 190. In some embodiments, the curtain fabric 172 may have a color and texture selected to match a front trim assembly 110 of the air conditioner system 100 (not shown in FIG. 4).

The components that allow the extension and retraction of the curtain fabric 172 and the curtain assembly 170 include a roller tube 176 around which the curtain fabric 172 is rolled (to take in or let out fabric as the curtain assembly 170 extends or retracts). A fixed end rod 174 is attached to the edge of the curtain fabric that is positioned adjacent to the frame body 132 and the curtain fabric 172 has one or more recesses 175 that permit clips on the frame body 132 (not shown) to clip onto the fixed end rod 174, retaining the fixed end rod 174 in position adjacent to the frame body 132.

The roller tube 176 is capped on either end by a spring cap 182 and a roller cap 184. The roller cap 184 is retained in position using a fixing screw 186 while the spring cap 182 is positioned using a curtain foot 188 or clip. A return spring 180 is positioned within the roller tube 176 on the spring cap 182 and is configured to allow the curtain fabric 172 to be wound onto the roller tube 176 as the curtain assembly 170 is moved toward the air conditioner unit 190. The roller components are positioned at an outer edge of an interior of the frame 134 using a pivot rod 178 that extends through the roller tube 176 from the curtain foot 188 to the roller cap 184 (each of which are mounted on the frame 134). The resulting configuration allows the curtain assembly 170 to easily be extended and retracted from the air conditioner unit 190 as needed to close the window opening and provide a visually appealing and secure covering of that opening.

Figure 5:
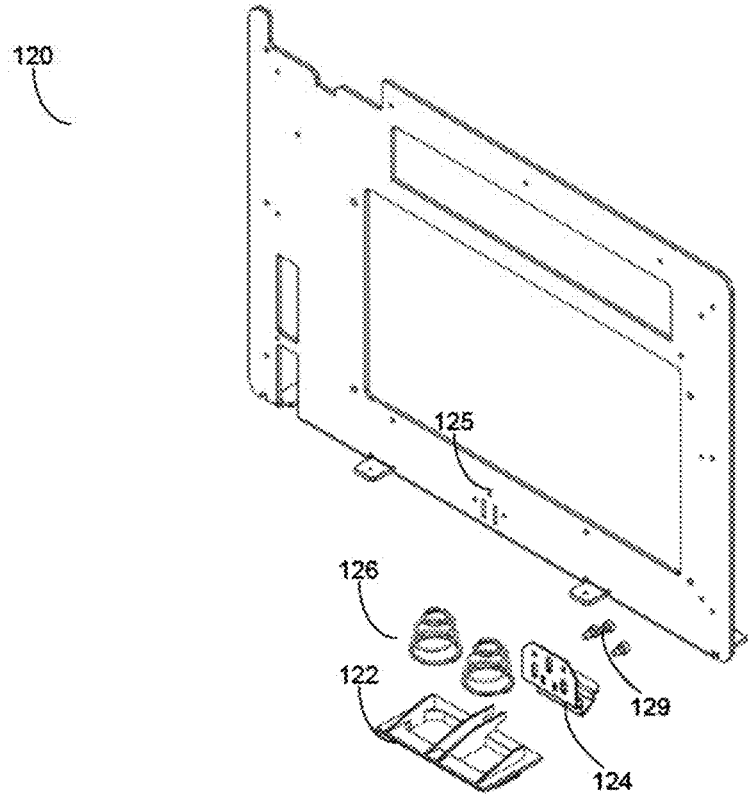
FIG. 5 is a view of a front plate and related components pursuant to some embodiments.

Reference is now made to FIG. 5 which is a view of a front plate 120 that may be used in some embodiments. Also shown in FIG. 5 are several components that variously interact or attach to the front plate 120 or other components of the system to provide a latching mechanism that holds an air conditioner unit 190 securely in place in a frame body 132. For example, as shown in FIG. 5, the latching mechanism may include a latch button 122, one or more latch springs 126, a latch catch 124 and one or more shoulder screws 129 for mounting the latch catch 124 to a latch mount area 125 of the front plate 120. In general, the front plate 120 is mounted using screws or other attachment mechanisms to the front trim assembly 110 and the mounting of the front plate 120 to the front trim assembly 110 holds the latch button 122 and related components as will be described below in conjunction with FIG. 6. Those skilled in the art, upon reading the present disclosure, will appreciate that other configurations of latching mechanisms may be used to securely connect the air conditioner unit 190 to the frame body 132 as will be described further herein.

Figure 6:
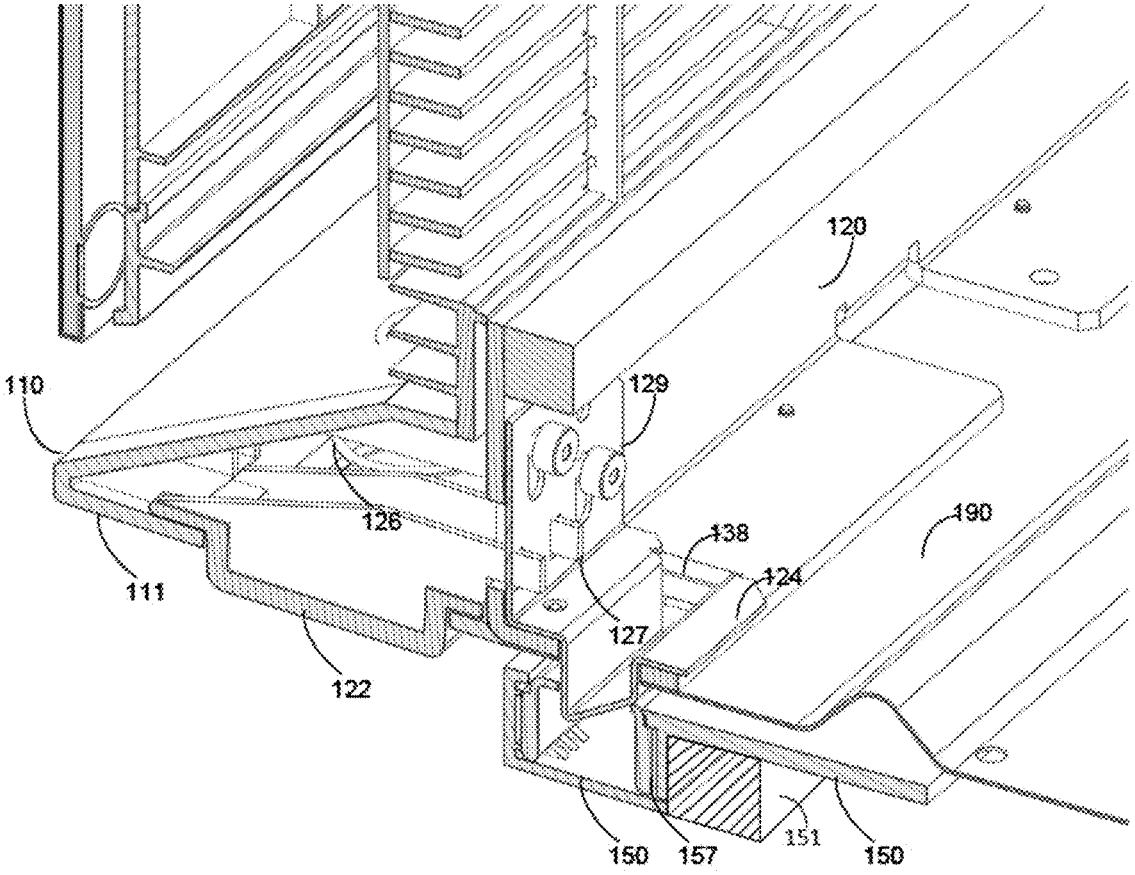
FIG. 6 is a section view of an air conditioner unit mounted in a frame pursuant to some embodiments.

FIG. 6 shows an embodiment of the present invention which uses a latch button and a latch catch as the latching mechanism. In the embodiment depicted, a single latch mechanism is positioned near the center of the bottom air conditioner unit 190. In some embodiments, two or more latch mechanisms may be used (e.g., such as one positioned on either side of the bottom of the air conditioner unit 190).

In the embodiment depicted, an air conditioner unit 190 with the front plate 120 and front trim assembly 110 are shown in an installed position (e.g., where the unit 190 has been inserted into the frame body 132 such that the latch mechanism has been engaged). As shown, the front trim 110 has a bottom lip 111 that extends backward (away from the front of the front trim assembly 110). One side of the latch button 122 sits on the bottom lip 111 and the other side of the latch button 122 sits on a tab that protrudes from the front plate 120. One or more latch springs 126 are positioned between the top of the latch button 122 and a lower surface of the front trim assembly 110 such that when the latch button 122 is depressed (from below, pushing in an upward direction), the latch springs 126 force the latch button 122 to return to its original position.

The latch button 122 includes one or more latch tabs 127 that extend through apertures of the front plate 120. The apertures of the front plate 120 allow the latch tabs 127 to move up and down as the latch button 122 is depressed or released. The latch tabs 127 extend through apertures of the latch catch 124 which is positioned on the back side of the front plate 120 (on the side away from the front trim assembly 110 and latch button 122). The apertures of the latch catch 124 are sized such that movement of the latch tabs 127 causes the latch catch 124 to move. The latch catch 124 is movably attached to the front plate 120 using one or more shoulder screws 129 that allow the latch catch 124 to move up and down as the latch button 122 is depressed and released. The natural resting position of the latch catch 124 is in a lowered position (in the position shown in FIG. 6).

When the air conditioner unit 190 (with the front plate 120 attached) is slid into the recess 142 of the frame body 132, the latch catch 124 is raised, allowing the unit to easily be slid into the recess 142. For example, as shown in FIG. 6, the latch catch 124 has one surface that is angled and another that is substantially vertical. The angled surface allows the latch catch 124 to slide along the bottom of the frame until the latch catch 124 mates with the recess 142. Further, the substantially vertical surface allows the latch catch 124 to help retain the air conditioner unit 190 in position when latched (as the portion of the air conditioner unit 190 that hangs outside the window acts to push the vertical surface of the latch catch 124 against the side of the recess 142). The latch catch 124 serves to provide a force that counter acts the rotational force exerted by the weight of the air conditioner unit 190.

For example, in some embodiments, the latch catch 124 (or other latch mechanism) may be chosen, at least in part, to counter act the rotational force. In general, the force at the latch catch 124 is generally a function of the mass of the air conditioner unit 190 and the size of the unit (where the height of the unit is generally the lever arm of the latch catch 124 and the distance from the window sill to the center of gravity of the unit is the lever arm of gravitational force). Those skilled in the art will appreciate that the force at the latch catch 124 may be determined using Newtons second law (where force is equal to mass times acceleration) and the torque formula (with no motion in the system, where torque is equal to force times the lever arm or radius). As a simple illustrative example, if the mass of the unit 190 is 35 kg, the height of the unit is 0.357 m and the distance from the point where the top of the unit is attached to the window sash is 0.16 m, the force exerted on the latch catch 124 is 153.7 Newtons. As such, the latch catch 124 should be sized, shaped and positioned to handle this force.

The result is a safe and secure mount of the unit in a way that allows a user to easily install the unit from within a building by simply sliding the unit into the frame body 132. When the air conditioner unit 190 is in the correct installed position (where the latch catch 124 is positioned above the latch recess 138 of the frame body 132), the latch catch 124 drops into place in the latch recess 138, securely holding the air conditioner unit 190 within the frame body 132. Due to the shape of the latch catch 124, the air conditioner unit is prevented from falling backwards out of the frame body 132. If a user wishes to remove the air conditioner unit 190 from the frame body 132, the latch button 122 simply need be depressed to release the latch catch 124 from the latch recess 138. In this manner, embodiments provide secure and easy to control systems for mounting (and removing) air conditioner units. The latching mechanism of the present invention allows easy removal while ensuring that heavy air conditioner units do not inadvertently fall out of the window. While a latch button and latch catch are described, other types of latch mechanisms may also be provided as will be described further below.

Figure 7:
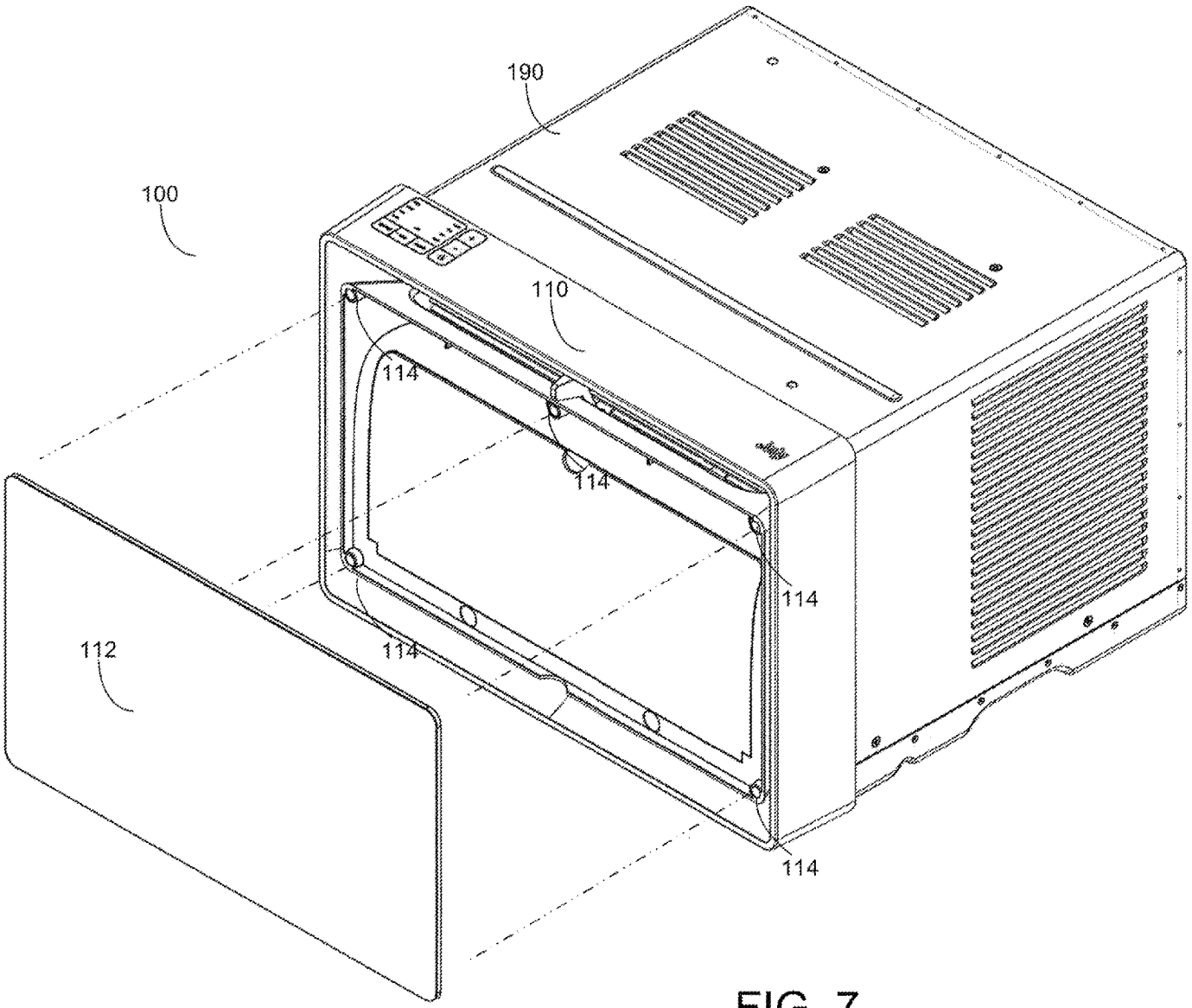
FIG. 7 is a front facing exploded view of an air conditioner system pursuant to some embodiments.

Reference is now made to FIG. 7 where a perspective view of portions of an air conditioner system 100 pursuant to some embodiments of the present invention are shown. As shown, the front trim assembly 110 is mounted on a front face of the air conditioner unit 190. The front trim assembly 110 is provided with a removable, replaceable and decorative front panel 112 that may be removably attached to the front trim assembly 110 at a number of attachment points 114. As shown, five attachment points are provided, although those skilled in the art, upon reading the present disclosure, will appreciate that other numbers and positions of attachment points may be provided. Pursuant to some embodiments, the attachment points are magnets (that are either mounted in the front trim assembly 110 or on the front panel 112) that securely mate with and hold the front panel 112 to the front trim assembly 110 while allowing easy removal and replacement. Other attachment mechanisms may also be provided (such as, for example, velcro, button tabs, or other mechanisms that allow the front panel 112 to be securely and removably attached to a front trim assembly 110). Pursuant to some embodiments, the front panel 112 is covered or partially covered with a decorative element (such as fabric or the like) to enhance the look of the air conditioner system 100.

Figure 8:
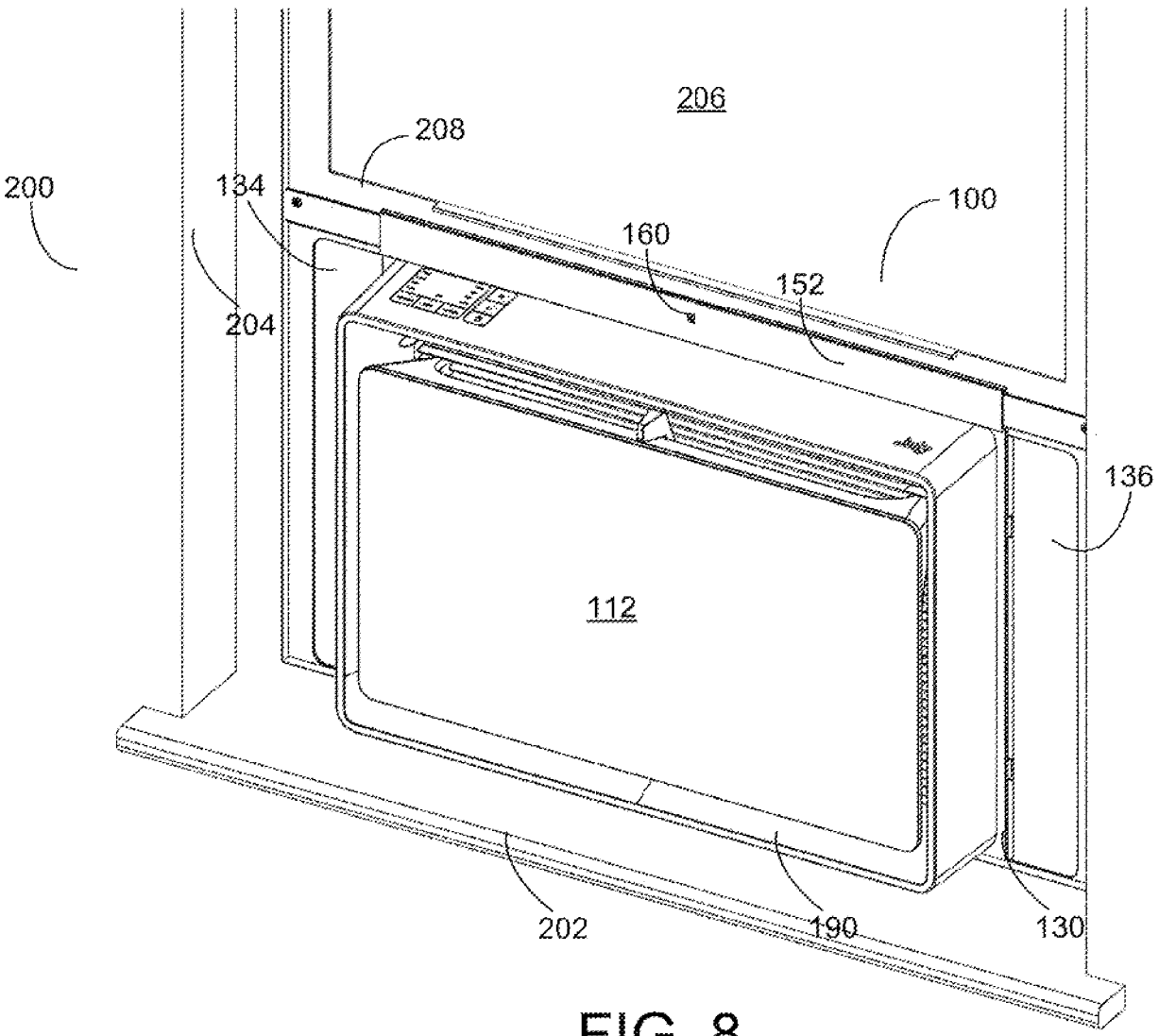
FIG. 8 is an interior view of an air conditioner system mounted in a window pursuant to some embodiments.

Reference is now made to FIG. 8 which shows a perspective view of an air conditioner system 100 installed in a window 200 of a building. The air conditioner system 100 may be installed in a variety of different types of windows or other openings, including, for example, double and single-hung windows. As shown in FIG. 8, the air conditioner system 100 is shown as installed in a single hung window 200. The air conditioner system 100 is placed in an opening formed when the window sash 206 opened or lifted into a position creating a window opening greater than the size of the air conditioner unit 190. The air conditioner unit 190 is then installed by positioning the installation frame 130 in the opening such that the installation frame 130 extends between the bottom frame 208 of the window sash 206 and the windowsill 202. The window sash 206 may be closed onto the installation frame 130 such that it rests against the frame lip 152. A screw may be threaded through the top rail mounting hole 160 into the bottom frame 208 of the window sash 206 to securely hold the installation frame 130 in the window opening.

With the installation frame 130 mounted in the window opening, the air conditioner unit 190 may be installed in the frame 130 as discussed elsewhere herein. The curtain assemblies 170 may be extended to substantially close the interior of the room from the outside. The result is an easily installed air conditioner unit 190 which is securely mounted in the window opening. The installation frame 130 provides a wide and stable base for the air conditioner unit 190 to rest on, and the latch assembly (not shown in FIG. 8) provides a secure connection between the air conditioner unit 190, the installation frame 130, the windowsill 202 and the bottom frame 208 of the window sash 206 ensuring the unit 190 stays mounted in the window opening.

Thus, embodiments provide improved air conditioner systems having installation frames that are first mounted within a window opening and that are configured to allow an air conditioner unit to be easily slid into the installation frame and securely latched to the frame. A user is easily able to install the unit from inside a building. Once installed and latched, the air conditioner unit is securely retained within the frame and in the window opening without need for additional platforms or security. Embodiments facilitate easy and secure installation and removal of air conditioner units.

The following illustrates various additional embodiments of the invention. These do not constitute a definition of all possible embodiments, and those skilled in the art will understand that the present invention is applicable to many other embodiments. Further, although the following embodiments are briefly described for clarity, those skilled in the art will understand how to make any changes, if necessary, to the above-described apparatus and methods to accommodate these and other embodiments and applications.

Figure 9A:
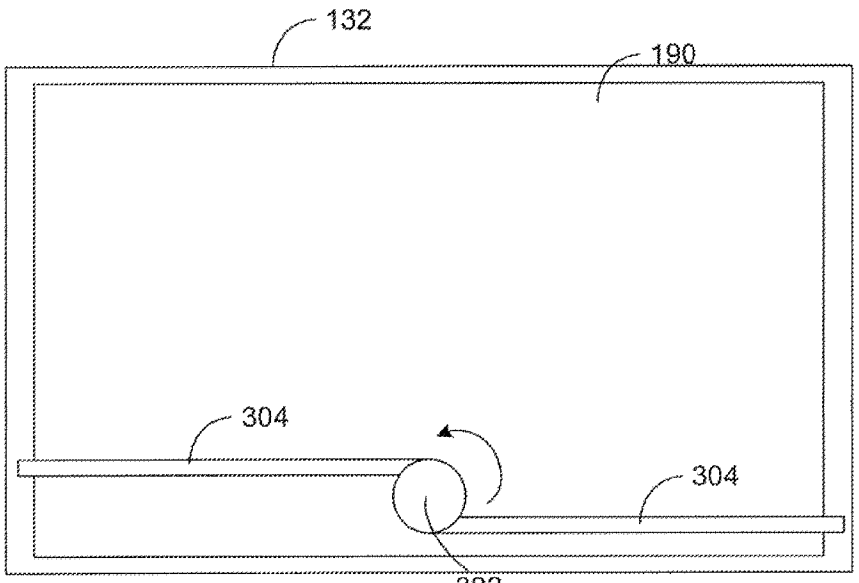
FIGS. 9A and 9B are illustrations of latching mechanisms pursuant to some embodiments.
Figure 9B:
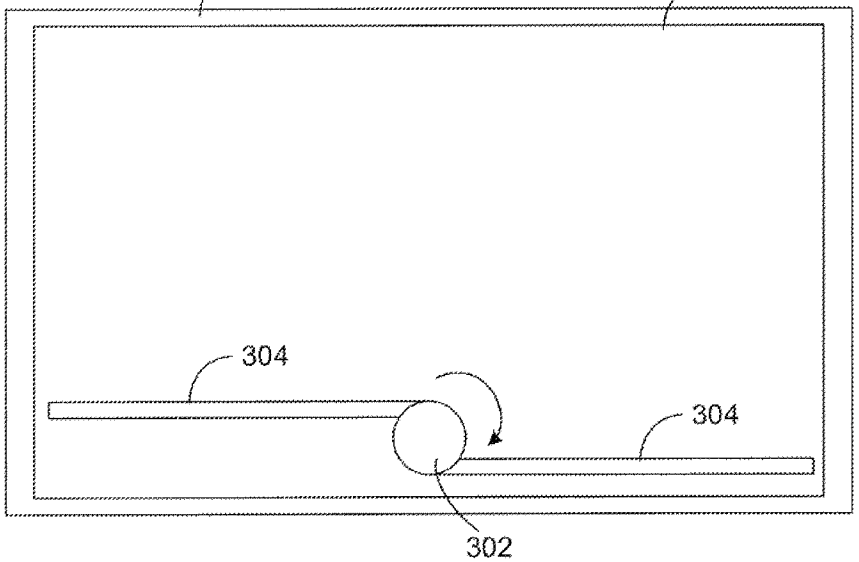
Figure 10A:
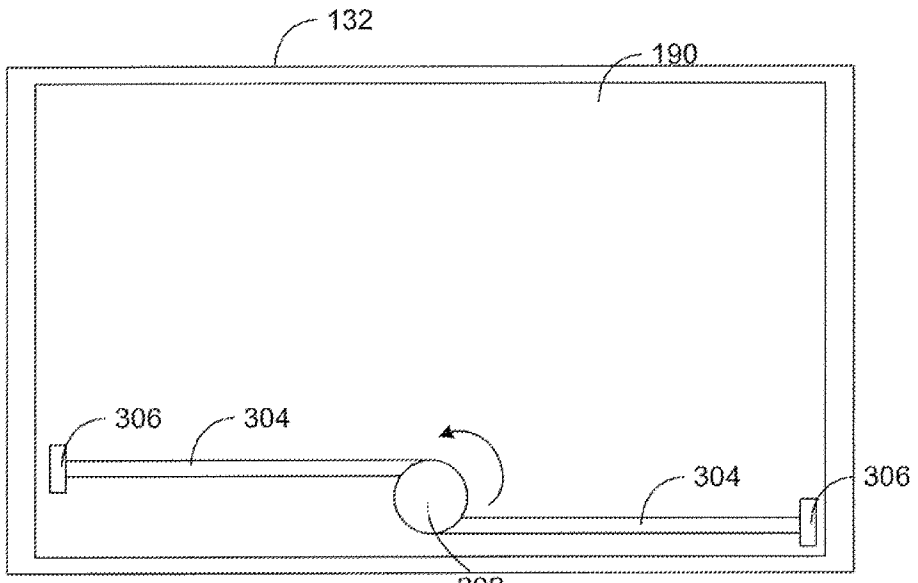
FIGS. 10A and 10B are illustrations of latching mechanisms pursuant to some embodiments.
Figure 10B:
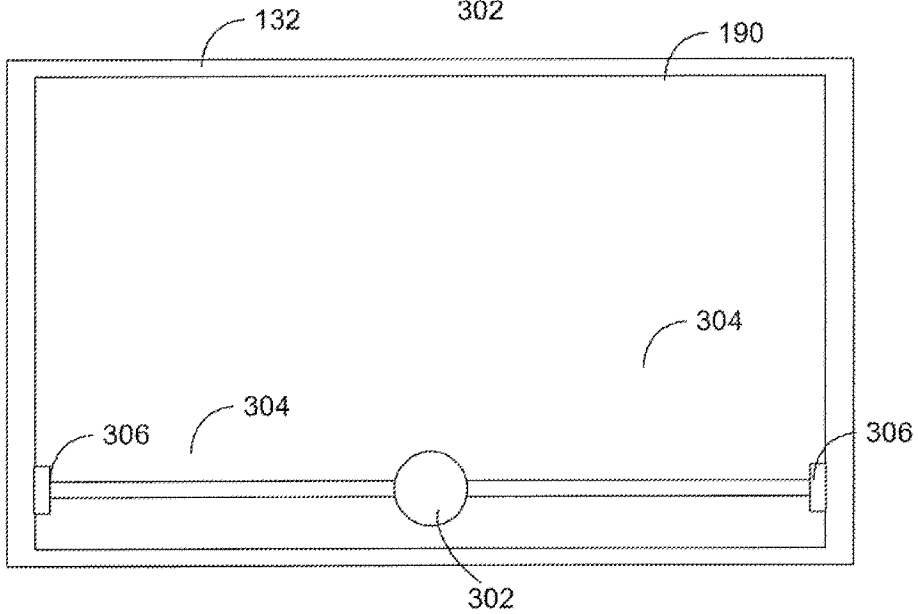
Figure 11A:
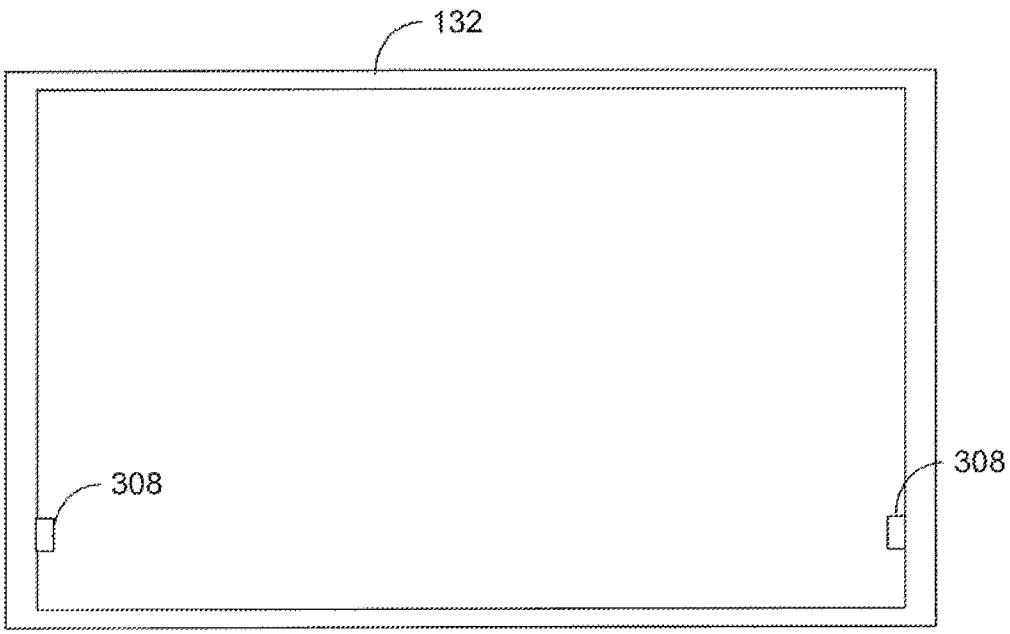
FIGS. 11A-11C are illustrations of latching mechanisms pursuant to some embodiments.
Figure 11B:
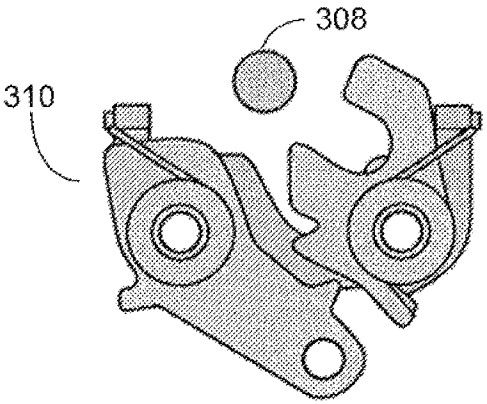
Figure 11C:
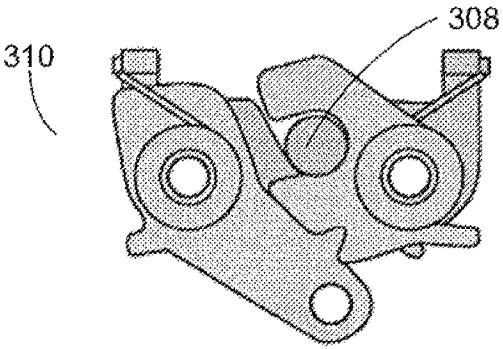

Although specific hardware configurations have been described herein, note that any number of other configurations may be provided in accordance with embodiments of the present invention. For example, while a frame body 132 has been described that is assembled from multiple pieces, embodiments may also be used with a unitary frame body or a frame body assembled from different components so long as a latching mechanism is provided and so long as a width of the frame body is sufficient to provide a stable platform to support an air conditioner unit. Further, while a button latch has been described, other latching mechanisms may be utilized. For example, referring to FIGS. 9A and 9B, a set of opposing slide latches may be used. In FIG. 9, an illustration of an embodiment is shown in which a slide latch is used as the latching mechanism. For example, a knob 302 may be provided on the air conditioner unit 190 (e.g., such as in the front trim assembly 110 or the like) which is accessible to a user. By rotating the knob 302, the user can engage (FIG. 9A) or disengage (FIG. 9B) the pins 304 from recesses in the frame body 132. As another example, referring to FIGS. 10A and 10B, a set of friction pads 306 may be used to hold the air conditioner unit 190 within the frame body 132. A knob 302 may be turned to engage (FIG. 10A) or disengage (FIG. 10B) the friction pads 306 from the frame body 132. As a still further example, referring to FIGS. 11A-11C, a set of pin and rotary catch latches 310 may be provided on the air conditioner unit 190 and positioned to engage with a set of pins 308 in the frame body 132.

The present invention has been described in terms of several embodiments solely for the purpose of illustration. Persons skilled in the art will recognize from this description that the invention is not limited to the embodiments described but may be practiced with modifications and alterations limited only by the spirit and scope of the appended claims.

What is claimed:

1. An air conditioner system, comprising:

an air conditioner unit having a latch mechanism positioned proximate a bottom surface of the air conditioner unit, the latch mechanism having a latch release mechanism and a latch engagement mechanism;

a frame body having a bottom rail, two side rails and a top rail, the frame body defining a recess shaped to fit the air conditioner unit; and the frame body having a latch recess for receiving the latch engagement mechanism and for securely retaining the latch mechanism when an air conditioner unit is inserted into the recess, wherein the latch release mechanism includes a button latch and the latch engagement mechanism includes a latch catch, the latch catch mating with the latch recess when positioned proximate the latch recess and the latch catch releasing from the latch recess when the button latch is depressed;

wherein the latch release mechanism is operatively connected to the latch engagement mechanism by one or more latch tabs that move upward when the button latch is depressed to cause the latch catch to release from the latch recess.

2. The air conditioner system of claim 1, wherein the top rail has a lip along an interior edge of the top rail, the lip positioned to fit proximate an interior bottom edge of a window sash and the bottom rail positioned on a window sill.

3. The air conditioner system of claim 2, wherein the bottom rail has at least a first bottom rail tab that is positioned to fit proximate an interior edge of an inner ledge of the window sill.

4. The air conditioner system of claim 3, wherein the at least first bottom rail tab prevents the flat bottom rail from moving outward from the inner ledge of the window sill.

5. The air conditioner system of claim 1, further comprising:

a first and a second curtain assembly, each mounted on the frame body and extendable outward from one of the two side rails such that the first and second curtain assemblies together with the frame body substantially extend a width of a window opening.

6. The air conditioner system of claim 1, wherein the latch catch has an angled surface such that when the latch catch and the air conditioner unit are inserted into the recess the angled surface allows the latch catch to push outward from the frame body.

7. The air conditioner system of claim 6, wherein the latch catch has a surface such that when the latch catch mates with the latch recess the surface acts to inhibit the air conditioner unit from moving.

8. The air conditioner system of claim 1, wherein the air conditioner unit further comprises:

a front trim assembly, mounted on a face of the air conditioner unit; and a front panel removably mounted on a face of the front trim assembly.

9. The air conditioner system of claim 8, wherein the front panel is removably mounted to the front trim assembly using a plurality of magnets.

10. An installation kit for mounting an air conditioner unit in an opening, the installation kit comprising:

a frame body having a bottom rail, two side rails and a top rail, the top rail having a lip along an interior edge of the top rail, the lip positioned to fit proximate a top portion of the opening and the bottom rail positioned on a bottom surface of the opening, the frame body defining a recess shaped to fit the air conditioner unit;

the bottom rail having a latch recess to receive a latch mechanism and to securely retain the latch mechanism when an air conditioner unit is inserted in the recess, the bottom rail further having at least a first bottom rail tab positioned to fit proximate an interior edge of an inner ledge of the bottom surface of the opening; and a latch mechanism positioned proximate a base of the air conditioner, the latch mechanism including a button and a latch catch, the latch catch movable between a first position and a second position by depressing the button;

wherein the latch catch mates with the latch recess when the latch catch is in a first position; and wherein the latch button is connected to the latch catch via one or more latch tabs.

11. The installation frame of claim 10, further comprising:

a first and a second curtain assembly, each mounted on the frame body and extendable outward from one of the two side rails such that the first and second curtain assemblies together with the frame body substantially extend a width of the opening.

12. A method for installing an air conditioner unit in an opening, the opening extending from an interior of a building to an exterior of the building, the method comprising:

positioning a frame body in the opening, the frame body having a bottom rail, two side rails and a top rail, the top rail having a lip along an interior edge of the top rail, the bottom rail having a latch recess formed therein;

adjusting a top edge of the opening such that the top edge is proximate the top rail and the lip; and inserting the air conditioner unit into a recess defined by the frame body until a latch mounted on the air conditioner unit mates with a latch recess formed in the frame body;

wherein the latch is positioned proximate a bottom of the air conditioner unit, the latch having an angled face such that the latch moves upwardly as the angled face passes along the bottom rail and the latch mates with the latch recess when the latch is positioned proximate the latch recess and wherein the angled face of the latch is disengaged from the latch recess by depressing a latch button that is connected to the latch face via one or more latch tabs.

13. The method of claim 12, wherein the latch is mounted on a front plate of the air conditioner unit and the latch button faces the bottom of the air conditioner unit.

14. The method of claim 12, further comprising:

extending a first and a second curtain assembly outward from one of the two side rails such that the first and second curtain assemblies together with the frame body substantially extend a width of the opening.

* * * * *